US008434829B2

(12) United States Patent
Gregory

(10) Patent No.: US 8,434,829 B2
(45) Date of Patent: May 7, 2013

(54) METHOD AND SYSTEM OF RETAINING A CUTTING BIT

(75) Inventor: Norman Scott Gregory, Carlsbad, NM (US)

(73) Assignee: Gregory Rockhouse Ranch, Inc., Carlsbad, NM (US)

( * ) Notice: Subject to any disclaimer, the term of this patent is extended or adjusted under 35 U.S.C. 154(b) by 348 days.

(21) Appl. No.: 12/779,162

(22) Filed: May 13, 2010

(65) Prior Publication Data

US 2011/0278908 A1 Nov. 17, 2011

(51) Int. Cl.
*E21C 35/19* (2006.01)
*E21C 35/193* (2006.01)
*E21C 35/197* (2006.01)

(52) U.S. Cl.
USPC ..... 299/113; 299/102; 299/104; 299/106; 299/107

(58) Field of Classification Search ..... 299/102, 299/103, 104, 106, 107, 110, 113
See application file for complete search history.

(56) References Cited

U.S. PATENT DOCUMENTS

| | | | | |
|---|---|---|---|---|
| 1,475,136 | A | 11/1923 | Olson | |
| 2,702,712 | A | 2/1955 | Snyder | |
| 2,766,029 | A | 10/1956 | Bruestle | |
| 3,223,452 | A | 12/1965 | Krekeler | |
| 3,254,922 | A | 6/1966 | Krekeler | |
| 3,397,012 | A * | 8/1968 | Krekeler | 299/102 |
| 3,436,107 | A | 4/1969 | Karden | |
| 4,337,980 | A * | 7/1982 | Krekeler | 299/102 |
| 5,029,944 | A | 7/1991 | Komotzki | |
| 5,106,166 | A * | 4/1992 | O'Neill | 299/104 |
| 5,302,005 | A | 4/1994 | O'Neill | |
| 5,605,382 | A | 2/1997 | Massa | |
| 7,380,889 | B2 * | 6/2008 | Frear | 299/107 |
| 8,061,783 | B2 * | 11/2011 | Keller et al. | 299/102 |
| 2010/0038955 | A1 * | 2/2010 | Keller et al. | 299/102 |

FOREIGN PATENT DOCUMENTS

GB 2111558 A * 7/1983

* cited by examiner

*Primary Examiner* — Sunil Singh
*Assistant Examiner* — Carib Oquendo
(74) *Attorney, Agent, or Firm* — Mark E. Scott; Conley Rose, P.C.

(57) ABSTRACT

Retaining a cutting bit. At least some of the illustrative embodiments are methods including: placing a neck portion of a retaining clip in a groove on outer surface of a sleeve (the sleeve with a cylindrical bore defining a longitudinal axis); then telescoping the sleeve and retaining clip, with the neck portion placed in the groove, within a bit block (the telescoping such that an arm portion of the retaining clip partially occludes an aperture of the cylindrical bore); and then inserting a shank portion of a cutting bit within the cylindrical bore of the sleeve (the arm portion of the retaining clip mates with at least a portion of an annular groove of the shank portion); and retaining the shank portion of the cutting bit by way of the arm portion of the retaining clip.

9 Claims, 8 Drawing Sheets

METHOD AND SYSTEM OF RETAINING A CUTTING BIT

BACKGROUND

In the mining industry a tool used to mine into a material is comprised of a rotating drum with a plurality of cutting bits attached thereto. During the mining operation the tool, particularly the cutting bits, are subjected to considerable stresses, and thus the cutting bits require frequent replacement due to wear or breakage. In some situations, the cutting bits may need to be replaced daily. Therefore, a device that enables quick and easy replacement of the cutting bits provides a competitive advantage.

BRIEF DESCRIPTION OF THE DRAWINGS

For a detailed description of exemplary embodiments, reference will now be made to the accompanying drawings in which.

NOTATION AND NOMENCLATURE

Certain terms are used throughout the following description and claims to refer to particular system components. As one skilled in the art will appreciate, companies may refer to a component by different names. This document does not intend to distinguish between components that differ in name but not function. In the following discussion and in the claims, the terms "including" and "comprising" are used in an open-ended fashion, and thus should be interpreted to mean "including, but not limited to . . . . " Thus, if a first device couples to a second device, that connection may be through a direct connection, through an indirect connection via other devices and connections.

"Notch" shall mean either: a channel on outer surface of a sleeve that is at an end of a longitudinal groove of the sleeve, and the channel intersects the longitudinal groove at an angle greater than zero degrees and less than 180 degrees; or a hole in the outer surface of the sleeve and at the end of the longitudinal groove.

"Dog portion" shall mean a portion of a retaining clip that is at an end of a neck portion of the retaining clip opposite an arm portion of the retaining clip.

"Quadrilateral cross section" shall mean either: a cross section with four sides; or a cross section with three sides that would be quadrilateral if the fourth side connected the unconnected sides.

DETAILED DESCRIPTION

The following discussion is directed to various embodiments of the invention. Although one or more of these embodiments may be preferred, the embodiments disclosed should not be interpreted, or otherwise used, as limiting the scope of the disclosure, including the claims. In addition, one skilled in the art will understand that the following description has broad application, and the discussion of any embodiment is meant only to be exemplary of that embodiment, and not intended to intimate that the scope of the disclosure, including the claims, is limited to that embodiment.

Figure 1A:
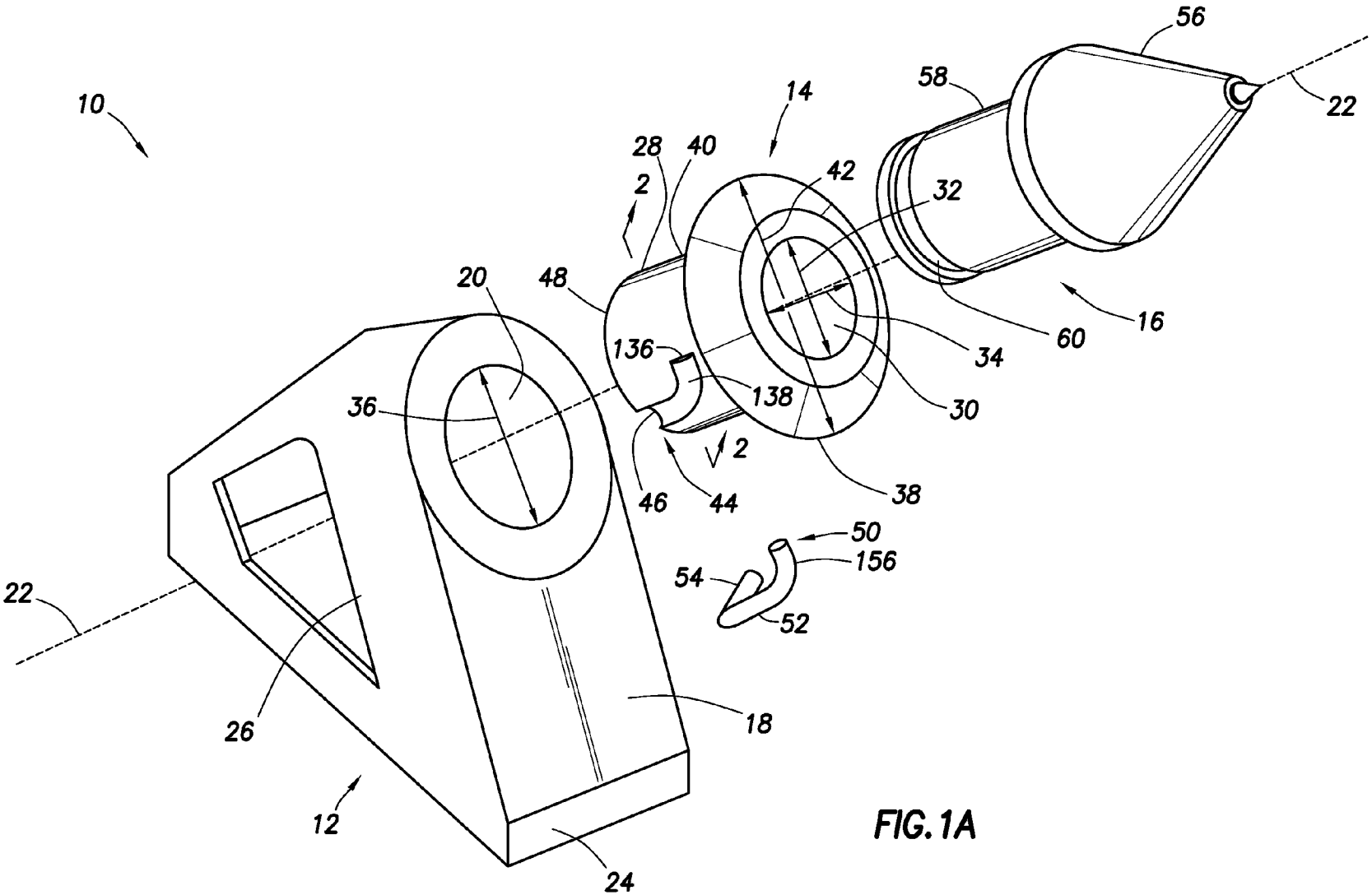
FIGS. 1A-1B show a perspective exploded view and a side elevation view, respectively, of a mining apparatus in accordance with at least some of the embodiments.

FIG. 1A illustrates a mining apparatus 10 in accordance with at least some embodiments. In particular, FIG. 1A illustrates an exploded view of a mining apparatus 10 comprising a bit block 12, a sleeve 14 and a cutting bit 16. The bit block 12 comprises a body portion 18 that defines a cylindrical bore 20 with a longitudinal axis 22 and an internal diameter 36. In the embodiments of FIG. 1A, the bit block 12 also comprises an aperture 26 through the body portion 18. The bit block 12 also comprises a base portion 24 that, in some embodiments, couples (e.g., by clamping or welding) to a cutting drum. The cutting drum with the attached bit block 12 is then rotated during the mining operation to mine the desired material.

The sleeve 14 comprises a cylindrical portion 28 that defines the longitudinal axis 22, an internal diameter 32 and an external diameter 34. In the particular embodiment, the external diameter 34 of the cylindrical portion 28 is larger than the internal diameter 36 of the cylindrical bore 20 of the bit block 12. This provides a "press fit" between sleeve 14 and bit block 12 in order to retain sleeve 14 when it is "pressed" into bit block 12. The sleeve 14 also comprises a top portion 38 at end 40 of the sleeve 14 that defines an external diameter 42 that is greater than the external diameter 34 of the cylindrical portion 28. In the particular embodiment, the sleeve 14 comprises a central bore 30 along the longitudinal axis 22 and through the cylindrical portion 28 and the top portion 38.

Still referring to FIG. 1A, the sleeve 14 also comprises a groove 44 on the outer surface of the cylindrical portion 28. The groove 44 is proximate to the end 48 of the sleeve 14, and the groove defines a channel 46 that is parallel to the longitudinal axis 22. The groove 44 also comprises a notch 136 that defines a channel 138 that intersects the channel 46 of the groove 44 at the end (i.e., the closed end of the groove 44) opposite the end 48 of the sleeve 14. In some embodiments, the groove 44 and notch 136 receive a retaining clip 50. In particular, a dog portion 156 is placed within the notch 136 and a neck portion 52 of the retaining clip 50 is placed within the groove 44 such that an arm portion 54 of the retaining clip 50 extends towards the longitudinal axis 22, and the arm portion 54 partially occludes an aperture of the central bore 30 of the sleeve 14. In some embodiments, the length of the arm portion 54 of the retaining clip 50 is at least one and a half times the length of the neck portion 52 of the retaining clip 50, and the retaining clip 50 may be constructed from any suitable temper spring material, such as carbon steel or beryllium alloy.

In some embodiments, the neck portion 52 of the retaining clip 50 is placed in the groove 44, the dog portion 156 is placed in the notch 136, and then the cylindrical portion 28 of the sleeve 14 is telescoped within the cylindrical bore 20 of the bit block 12. In particular, the cylindrical portion 28 of the sleeve 14 with retaining clip 50 is press-fit within the cylindrical bore 20 of the bit block 12. In other embodiments, the cylindrical portion 28 may be telescoped within the cylindrical bore 20 of the bit block 12 by way of other suitable methods.

Further, FIG. 1A also illustrates cutting bit 16 that comprises a conical bit portion 56 and a shank portion 58 that define the longitudinal axis 22. In the particular embodiment, the shank portion 58 has a cylindrical shape and comprises an annular groove 60, and the shank portion 58 telescopes within the central bore 30 of the sleeve 14. In some embodiments, when the shank portion 58 is telescoped within the central bore 30 of the sleeve 14, the retaining clip 50 may be used to retain the shank portion 58, and thus the cutting bit 16, within the sleeve 14.

Figure 1B:
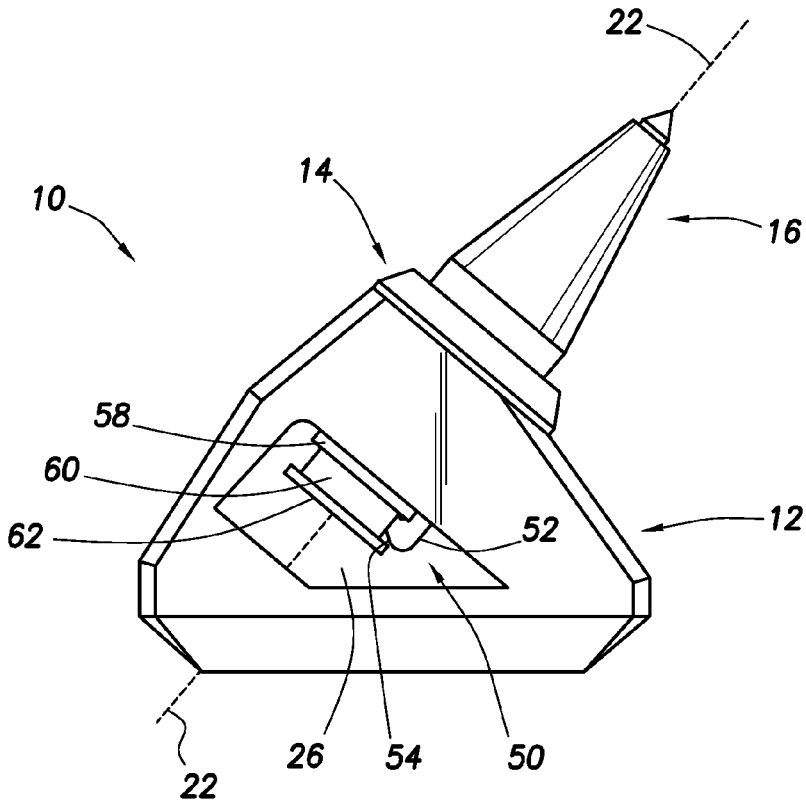

FIG. 1B illustrates the mining apparatus 10 in an assembled configuration. In particular, FIG. 1B illustrates the sleeve 14 telescoped within bit block 12 and the shank portion 58 of the cutting bit 16 telescoped within the sleeve 14. In the exemplary embodiment, the sleeve 14 is telescoped within the bit block 12 after the neck portion 52 of the retaining clip 50 is placed within the groove of the sleeve 14. As assembled, the arm portion 54 of the retaining clip 50 partially occludes an aperture of the central bore of the sleeve 14. Thereafter, the shank portion 58 of the cutting bit 16 is inserted within the sleeve 14 such that the arm portion 54 of the retaining clip 50 mates with a portion of the annular groove 60 of the shank portion 58. For example, the arm portion 54 may be reached through the aperture 26 of the bit block 12 and rotated or deflected away from the shank portion 58 to torsion the neck portion 52, and then the shank portion 58 is inserted into the sleeve 14 until the annular groove 60 mates the arm portion 54. Similarly, to release the arm portion 54 from the annular groove 60 the arm portion 54 is again rotated or deflected away from the shank portion 58 and thus out of the annular groove 60. In alternative embodiments, the shank portion 58 is beveled at the end 62, and thus when the shank portion 58 is inserted within the sleeve 14 the beveled end 62 rotates or deflects the arm portion 54 away from the shank portion 58 to mate the arm portion 54 with the annular groove 60.

Figure 2:
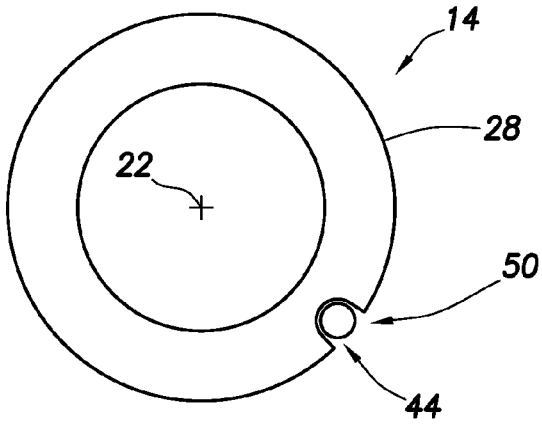
FIG. 2 shows a cross sectional view take along line 2-2 of FIG. 1A and of the mining apparatus in accordance with at least some of the embodiments.

FIG. 2 illustrates a cross sectional view of the sleeve 14 taken along lines 2-2 of FIG. 1A. In particular, FIG. 2 illustrates a cross sectional view of the cylindrical portion 28 of the sleeve 14 as well as a cross sectional view of the groove 44 on the outer surface of the cylindrical portion 28. In the exemplary embodiment, the groove 44 defines a semi-circular cross section, and the retaining clip 50 defines a circular cross section. In the particular embodiment, when the sleeve 14 with the retaining clip 50 in the groove 44 is telescoped within the bit block, the location of the groove 44 relative to the longitudinal axis 22 is such that the arm portion of the retaining clip 50 is configured to mate with the annular groove of the shank portion of the cutting bit (as illustrated in FIG. 1B). Locating the groove 44 with the retaining clip 50 in such locations enables the arm portion of the retaining clip 50 to mate with the annular groove of the shank portion of the cutting bit, and retain the cutting bit within the sleeve 14.

Figure 3A:
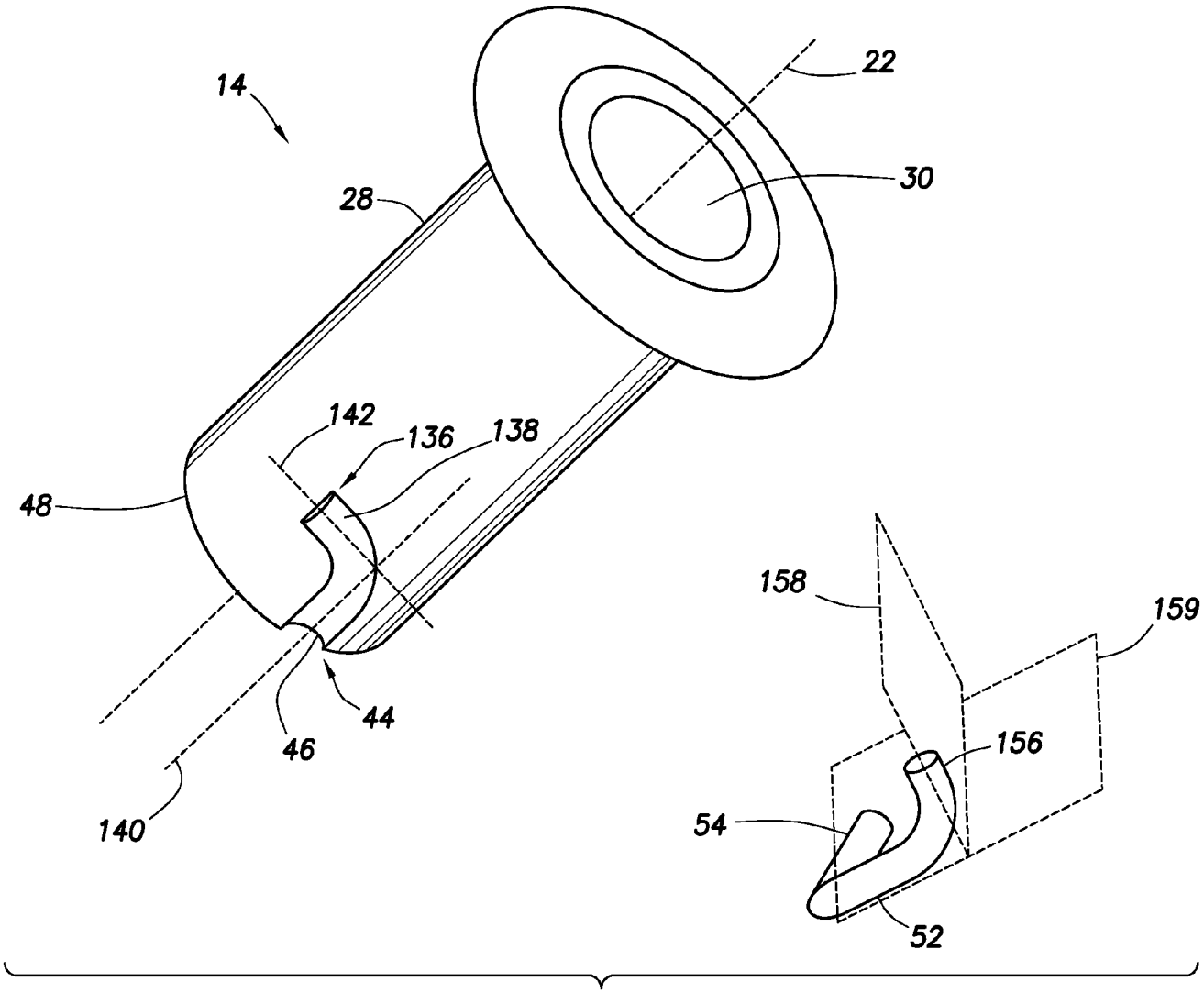
FIGS. 3A-3B show perspective view of a sleeve and a retaining clip in accordance with at least some of the embodiments.

FIG. 3A illustrates a sleeve 14 similar to the embodiments of FIGS. 1A-1B and FIG. 2 with a groove 44 that defines a semi-circular cross section on the outer surface of the cylindrical portion 28 of the sleeve 14. In particular, the groove 44 is proximate to the end 48 of the sleeve 14, and the groove defines a channel 46 that is parallel to the longitudinal axis 22. The groove 44 also comprises a notch 136 that defines a semi-circular cross section. The notch 136 defines a channel 138 that intersects the channel 46 of the groove 44 at the end (i.e., the closed end of the groove 44) opposite the end 48 of the sleeve 14. In some embodiments, an axis 140 that bisects the groove 44 intersects an axis 142 that bisects the notch 136 at an angle that is 90 degrees. In other embodiments, the axis 140 and the axis 142 may intersect at any angle that is greater than zero degrees and less than 180 degrees.

FIG. 3A also illustrates a retaining clip 50 that comprises a neck portion 52, an arm portion 54 and a dog portion 156, and the retaining clip 50 has a circular cross section. In particular, the dog portion 156 is at an end of the neck portion 52 that is opposite the arm portion 54. The dog portion 156 is placed within the notch 136 and the neck portion 52 is placed within the groove 44 such that the arm portion 54 partially occludes an aperture of the central bore 30 of the sleeve 14. In some embodiments, a plane 158 that bisects the dog portion 156 intersects a plane 159 that bisects the neck portion 52 at a 90 degree angle. In other embodiments, the plane 158 that bisects the dog portion 156 intersects the plane 159 that bisects the neck portion 52 at any angle that is greater than zero degrees and less than 180 degrees.

Figure 3B:
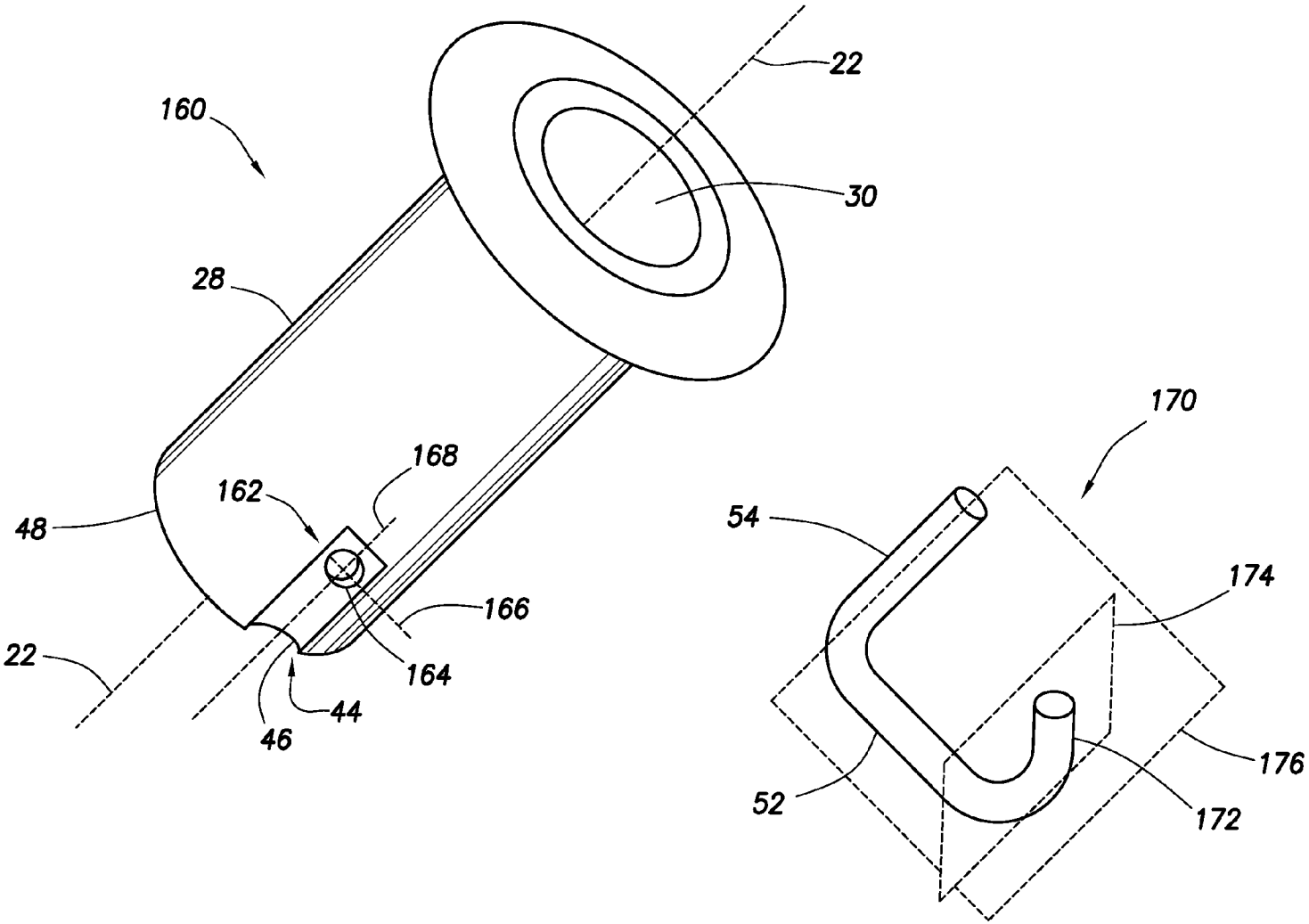

FIG. 3B illustrates a sleeve 160 similar to the embodiments of the FIG. 3A, but the sleeve 160 comprises a notch 162 in the form of a hole 164 in the cylindrical portion 28 of the sleeve 160. In particular, the notch 162 is within the groove 44 and the notch 162 is proximate to an end of the groove 44 (i.e., the closed end of the groove 44) that is opposite the end 48 of the sleeve 160. The notch 162 defines an axis 166, and the axis 166 defined by the notch 162 and an axis 168 that bisects the groove 44 intersect at an angle of 90 degrees. In other embodiments, the axis 166 defined by the notch 162 and the axis 168 that bisects the groove 44 may define any angle that is greater than zero degrees and less than 180 degrees. In the particular embodiment, the notch 162 also defines a circular cross section. In other embodiments, the notch 162 may define a cross section of any shape, such as a quadrilateral cross section or a polygonal cross section.

FIG. 3B also illustrates a retaining clip 170 with a dog portion 172 with a cross section similar to the cross section of the notch 162. In particular, the dog portion 172 is inserted in the notch 162 and the neck portion 52 of the retaining clip 170 is placed in the groove 44 such that the arm portion 54 partially occludes an aperture of the central bore 30 of the sleeve 160. In some embodiments, a plane 174 that bisects the dog portion 172 intersects a plane 176 that bisects the neck portion 52 at a 90 degree angle. In other embodiments, the plane 174 intersects the plane 176 at any angle that is greater than zero degrees and less than 180 degrees.

Figure 4A:
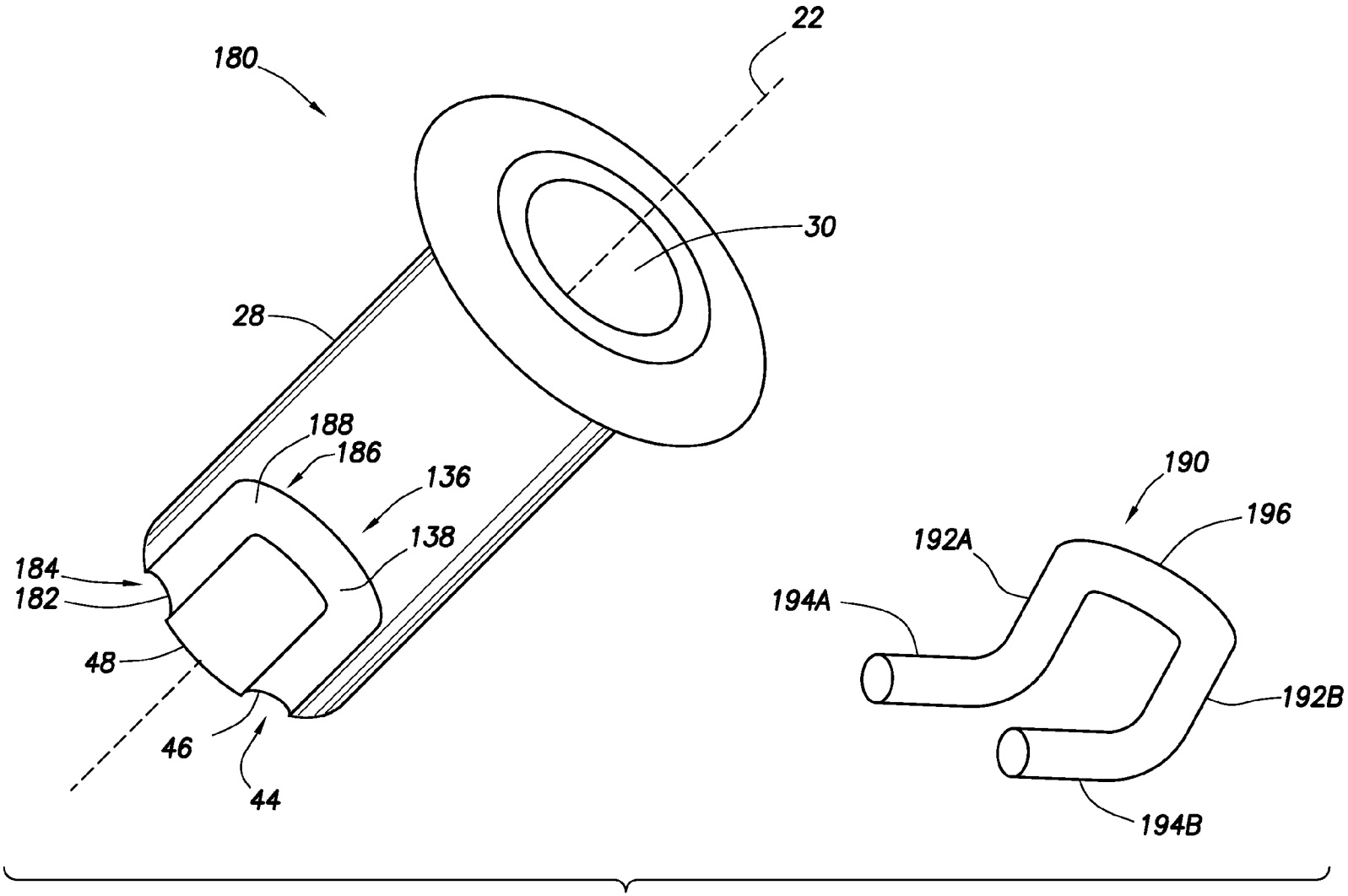
FIGS. 4A-4B show perspective view of a sleeve and a retaining clip in accordance with at least some of the embodiments.

FIG. 4A illustrates a sleeve 180 similar to the embodiments of FIG. 3A, but the sleeve 180 has a groove 44 and a groove 182 on the outer surface of the cylindrical portion 28 of the sleeve 180. In particular, the groove 44 and groove 182 are symmetric, and the groove 44 and the groove 182 define a channel 46 and a channel 184, respectively. In the particular embodiment, the groove 44 and the groove 182 are parallel to the longitudinal axis 22 and define a semi-circular cross section. A notch 136 that defines a channel 138 intersects the channel 46 of the groove 44 at the end opposite the end 48 of the sleeve 180. A notch 186 that defines a channel 188 intersects the channel 184 of the groove 182 at the end opposite the end 48 of the sleeve 180. In the exemplary embodiments, the notch 136 and the notch 186 are connected. Stated otherwise, the channel 138 of the notch 136 and the channel 188 of the notch 138 combine to form a single channel.

FIG. 4A also illustrates a retaining clip 190 that comprises neck portions 192A-B, arm portions 194A-B and a dog portion 196. In particular, the dog portion 196 is at an end of the neck portions 192A-B that is opposite the arm portions 194A-B. The dog portion 196 is disposed within the notch 136 and the notch 186, the neck portion 192A is disposed within the groove 44 and the neck portion 192B is disposed within the groove 182 such that the arm portions 194A-B partially occlude an aperture of the central bore 30 of the sleeve 180.

Figure 4B:
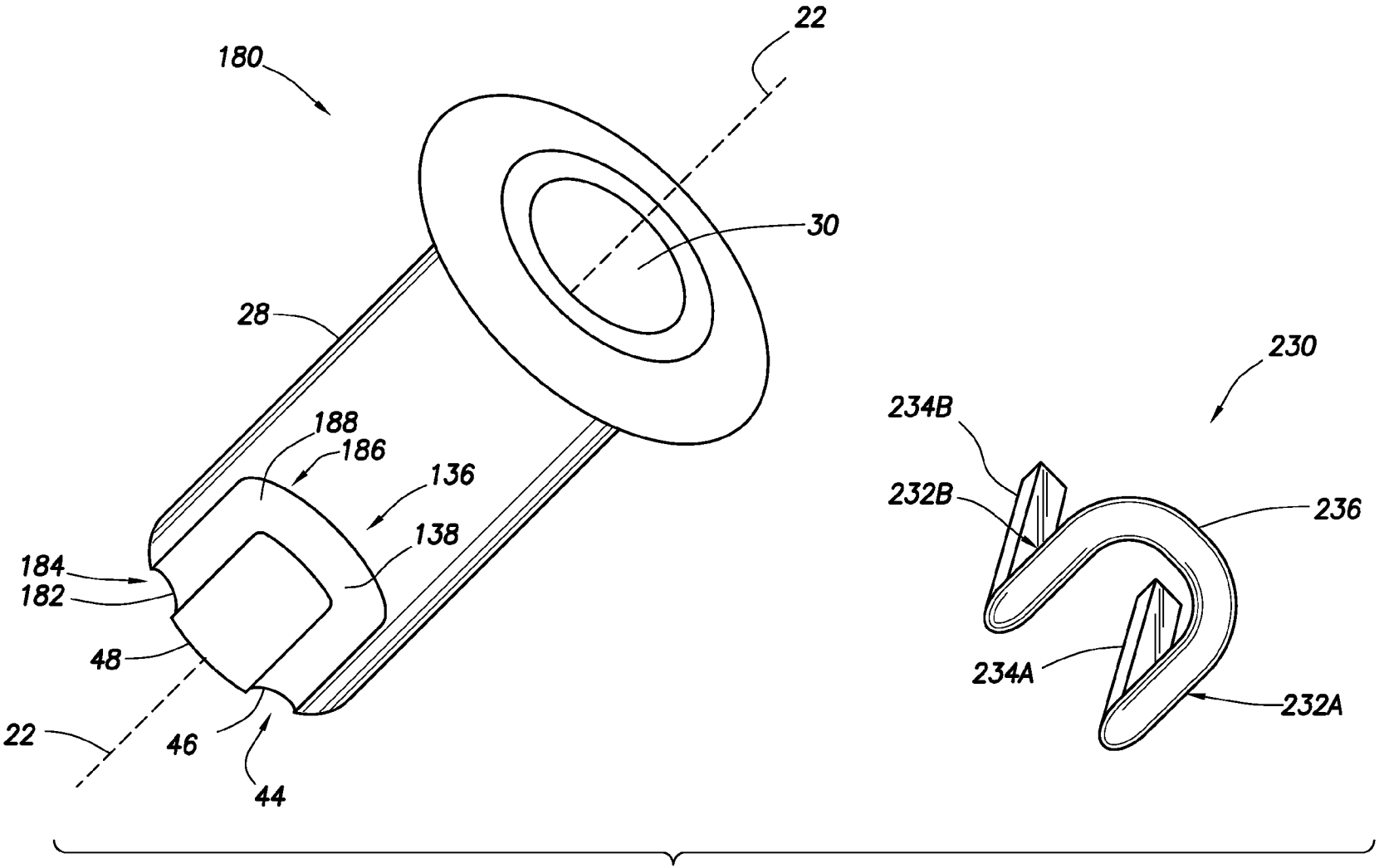

FIG. 4B illustrates a sleeve 180 similar to the embodiments of FIG. 4A with a groove 44 and a notch 136, and a groove 182 and a notch 186 on the outer surface of the cylindrical portion 28 of the sleeve 180. FIG. 4B also illustrates a retaining clip 230 that comprises neck portions 232A-B, arm portions 234A-B and a dog portion 236. In particular embodiment, the neck portions 232A-B and the dog portion 236 define a semi-circular cross-section, and the arm portions 234A-B define a quadrilateral cross-section. The dog portion 236, that is at an end of the neck portions 232A-B that is opposite the arm portions 234A-B, is disposed within the notch 136 and the notch 186, the neck portion 232A is disposed within the groove 44, and the neck portion 232B is disposed within the groove 182 such that the arm portions 234A-B partially occlude an aperture of the central bore 30 of the sleeve 180.

Figure 5:
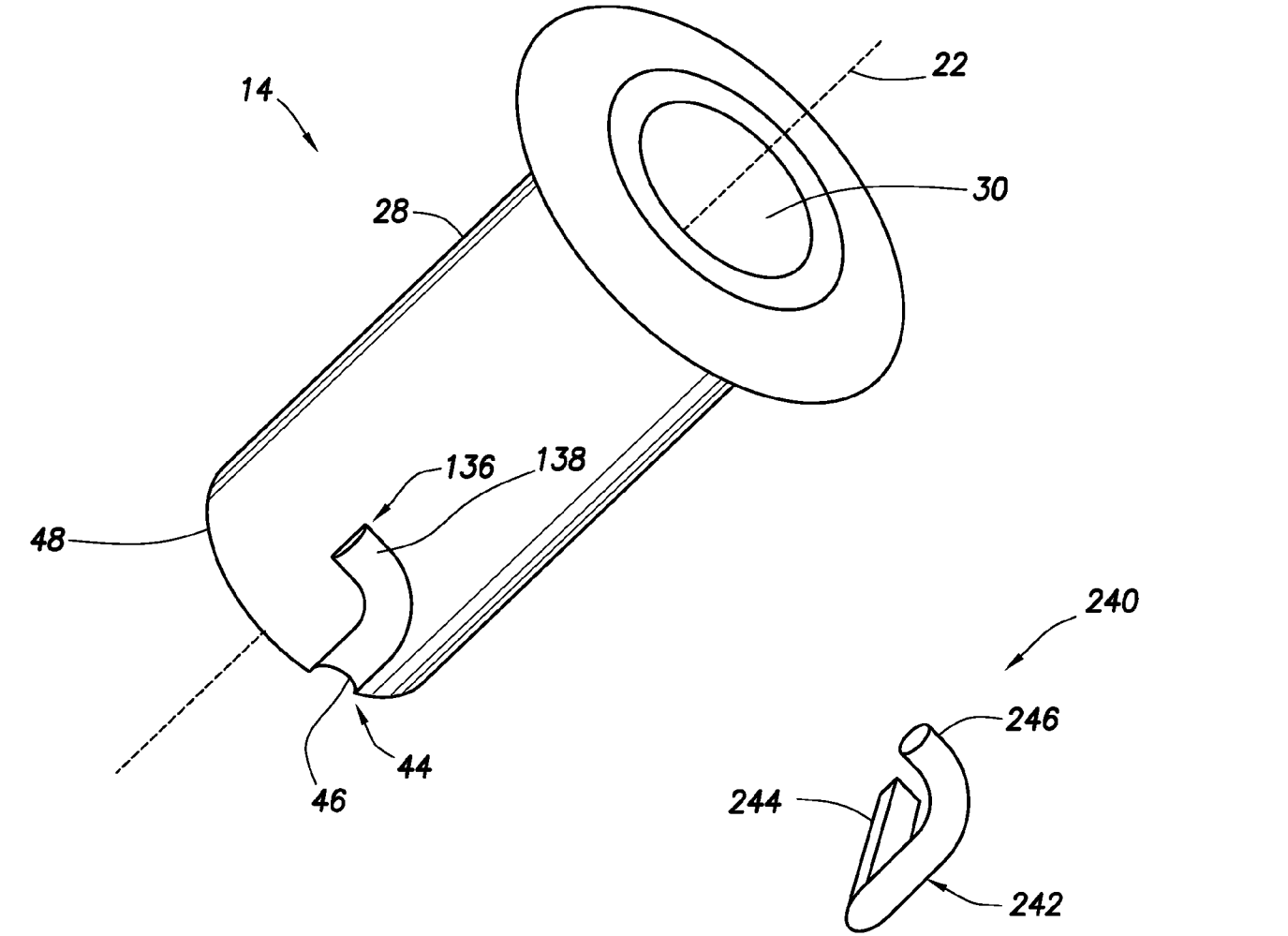
FIG. 5 shows perspective view of a sleeve and a retaining clip in accordance with at least some of the embodiments.

FIG. 5 illustrates a sleeve 14 with the groove 44 and notch 136 on the outer surface similar to the embodiments of FIG. 1A-B and FIG. 2. In particular, the groove 44 and the notch 136 define a semi-circular cross section. FIG. 5 also illustrates a retaining clip 240 that comprises a neck portion 242, an arm portion 244 and a dog portion 246. In particular, the dog portion 246 is at an end of the neck portion 242 that is opposite the arm portion 244. In the particular embodiment, the neck portion 242 and the dog portion 246 define a circular cross-section, and the arm portion 244 defines a quadrilateral cross-section. The dog portion 246 is placed within the notch 136 and the neck portion 242 is placed within the groove 44 such that the arm portion 244 partially occludes an aperture of the central bore 30 of the sleeve 14. In alternative embodiments, the notch and the dog portion may be similar to the embodiments of FIG. 3B.

Figure 6:
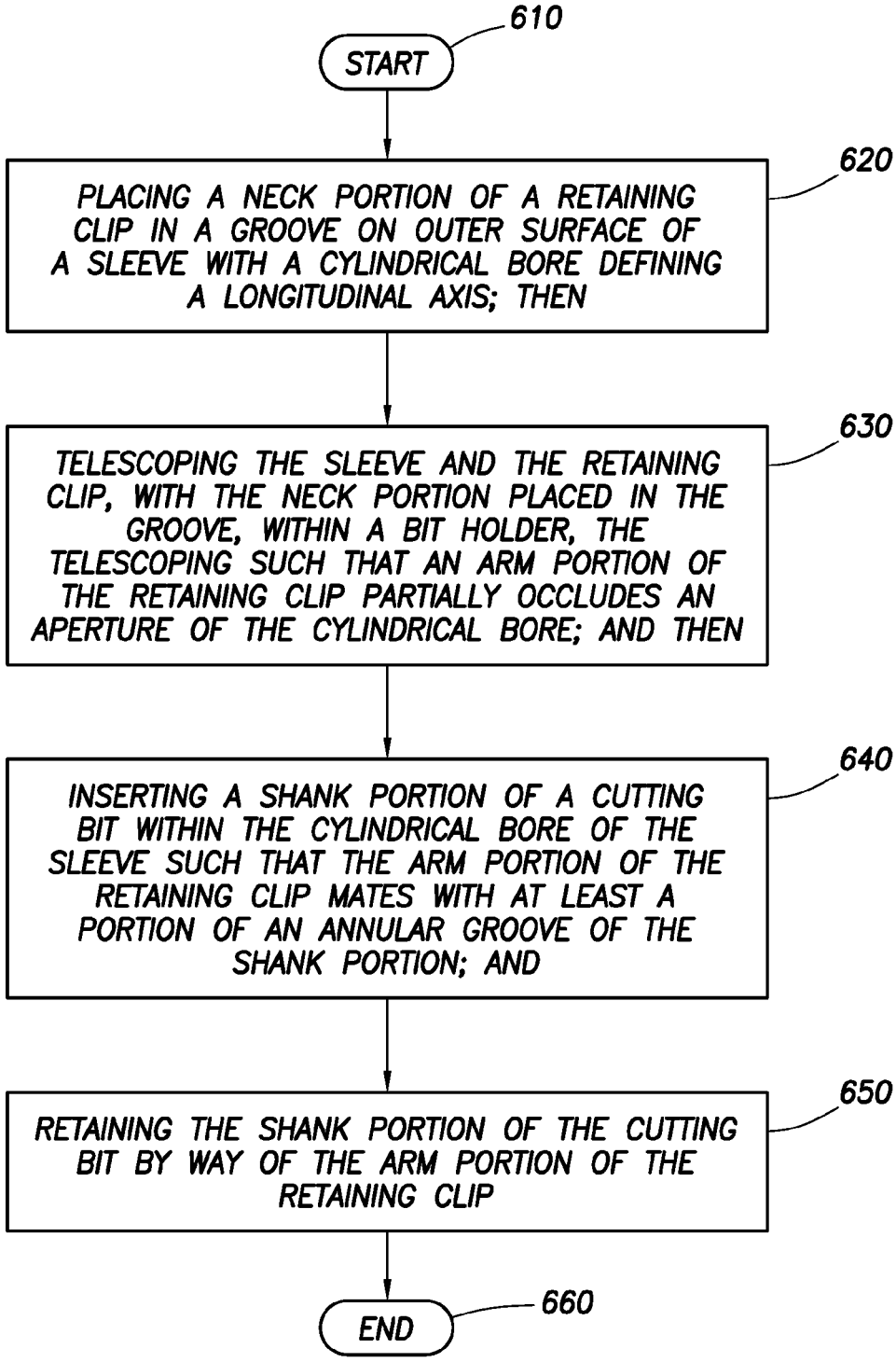
FIG. 6 shows a method in accordance with at least some of the embodiments.

The sleeves and the corresponding retaining clips in accordance with the embodiments of FIGS. 1A-1B, FIGS. 3A-3B, FIGS. 4A-4B and FIG. 5 may be used to carry out the method in accordance with the embodiments of FIG. 6. In particular, the method begins (block 610), and a neck portion of a retaining clip is placed in a groove on outer surface of a sleeve (block 620). In some embodiments, the sleeve comprises a cylindrical bore defining a longitudinal axis. Thereafter, the sleeve with the neck portion of the retaining clip placed in the groove is telescoped within a bit block such that an arm portion of the retaining clip partially occludes an aperture of the cylindrical bore (block 630). Next, a shank portion of a cutting bit is inserted within the cylindrical bore of the sleeve such that the arm portion of the retaining clip mates with at least a portion of an annular groove of the shank portion (block 640). Finally, the shank portion of the cutting bit is retained by way of the arm portion of the retaining clip (block 650), and the method ends (block 660).

The above discussion is meant to be illustrative of the principles and various embodiments. Numerous variations and modifications will become apparent to those skilled in the art once the above disclosure is fully appreciated. For example, the groove on the outer surface of the sleeve may define cross section of any shape, such as polygonal cross section. In particular, the groove defines a quadrilateral cross section by a two side walls and a bottom wall, and a retaining clip that also defines a quadrilateral cross section is placed in the groove. Moreover, the sleeve may comprise plurality of grooves on the outer surface that are distinct from each other and separated from each other. It is intended that the following claims be interpreted to embrace all such variations and modifications.

What is claimed is:

1. A system comprising:

a bit block comprising a body portion that defines a cylindrical bore with a longitudinal axis;

a sleeve telescoped within the cylindrical bore of the bit block, the sleeve comprising a first circular end, a second circular end and a groove on an outer surface of the sleeve, the groove defines a channel parallel to the longitudinal axis, and the groove proximate to the first circular end;

a cutting bit that defines a bit portion and a shank portion, the shank portion telescoped within the sleeve through the second circular end of the sleeve; and a retaining clip that defines an arm portion and a neck portion, the neck portion disposed within the groove, and the arm portion retains the shank portion of the cutting bit within the sleeve.

2. The system of claim 1 wherein the sleeve is press-fit within the cylindrical bore of the bit block.

3. The system of claim 1 wherein the groove defines a semi-circular cross section.

4. The system of claim 1 wherein the groove defines a semi-circular cross section, and the groove comprises a notch at an end of the groove opposite the first circular end.

5. The system of claim 4 wherein the retaining clip further comprises a dog portion at an end of the neck portion that is opposite the arm portion, and the dog portion disposed within the notch of the groove.

6. The system of claim 1 wherein the shank portion of the cutting bit comprises an annular groove, the annular groove receives the arm portion of the retaining clip.

7. The system of claim 1 wherein length of the arm portion is at least one and a half times the length of the neck portion.

8. The system of claim 1 wherein the bit block comprises an aperture configured to enable release of the arm portion of the retaining clip from the shank portion of the cutting bit.

9. The system of claim 1 wherein the retaining clip comprises spring temper material selected from the group consisting of: carbon steel; and beryllium alloy.

* * * * *